US007131228B2

(12) United States Patent
Hochstrate et al.

(10) Patent No.: US 7,131,228 B2
(45) Date of Patent: Nov. 7, 2006

(54) MODULAR FIREARM

(75) Inventors: Paul Hochstrate, Plantsville, CT (US); Laurance Robbins, Plainville, CT (US); Arthur F. Daigle, Plymouth, CT (US)

(73) Assignee: Colt Defense LLC, West Hartford, CT (US)

( * ) Notice: Subject to any disclaimer, the term of this patent is extended or adjusted under 35 U.S.C. 154(b) by 0 days.

(21) Appl. No.: 11/154,738

(22) Filed: Jun. 16, 2005

(65) Prior Publication Data

US 2006/0026883 A1 Feb. 9, 2006

Related U.S. Application Data

(60) Provisional application No. 60/580,256, filed on Jun. 16, 2004.

(51) Int. Cl.
*F41A 21/00* (2006.01)

(52) U.S. Cl. ..... 42/75.01; 42/75.02; 42/75.03

(58) Field of Classification Search ..... 42/75.01, 42/75.02, 75.03
See application file for complete search history.

(56) References Cited

U.S. PATENT DOCUMENTS 2,447,091 A * 8/1948 Pope ..... 42/76.01
3,198,076 A * 8/1965 Stoner ..... 89/128
3,323,246 A * 6/1967 Loffler ..... 42/75.01
3,731,417 A * 5/1973 Moller et al. ..... 42/75.03
3,739,515 A * 6/1973 Koon, Jr. ..... 42/75.03
3,830,003 A * 8/1974 Clerke ..... 42/75.03
4,563,937 A * 1/1986 White ..... 89/185
4,756,228 A * 7/1988 Rath ..... 89/191.01
4,765,224 A * 8/1988 Morris ..... 89/191.01
5,010,676 A * 4/1991 Kennedy ..... 42/71.01
5,155,284 A * 10/1992 Flashkes ..... 42/75.02
5,173,564 A * 12/1992 Hammond, Jr. ..... 42/75.03
5,305,539 A * 4/1994 Von Kuster ..... 42/75.01
5,590,484 A * 1/1997 Mooney et al. ..... 42/111
5,711,102 A * 1/1998 Plaster et al. ..... 42/71.01
5,826,363 A * 10/1998 Olson ..... 42/75.01
6,212,814 B1 * 4/2001 Lambie ..... 42/75.03
6,293,040 B1 * 9/2001 Luth ..... 42/75.01
6,481,144 B1 * 11/2002 Chee et al. ..... 42/76.01
6,487,805 B1 * 12/2002 Reynolds ..... 42/75.03
6,487,806 B1 * 12/2002 Murello et al. ..... 42/75.03
6,508,027 B1 * 1/2003 Kim ..... 42/124
6,671,990 B1 * 1/2004 Booth ..... 42/75.01
6,694,660 B1 * 2/2004 Davies ..... 42/75.01
6,779,288 B1 * 8/2004 Kim ..... 42/72
6,836,990 B1 * 1/2005 Shiloni ..... 42/96
6,895,708 B1 * 5/2005 Kim et al. ..... 42/72
2002/0000059 A1 * 1/2002 Murello et al. ..... 42/75.03

(Continued)

*Primary Examiner*—Michael J. Carone
*Assistant Examiner*—Benjamin Lee
(74) *Attorney, Agent, or Firm*—Perman & Green, LLP

(57) ABSTRACT

An M-4 firearm having a lower receiver assembly and an upper receiver assembly. The upper receiver assembly is connected to the lower receiver assembly. The lower receiver assembly has a fire control assembly. The upper receiver assembly has a barrel and a hand guard. The hand guard has a venting features for allowing cooling air to pass therethrough. The hand guard has a heat shield mounted therein. The hand guard has at least one peripheral device mounting rail. The hand guard has an upper portion and a removable lower portion. The removable lower portion has at least one peripheral device mounting rail. The removable lower portion may be removed and replaced with a different second removable lower portion without the removal of fasteners.

2 Claims, 3 Drawing Sheets

U.S. PATENT DOCUMENTS

2003/0150151 A1* 8/2003 Orth ..... 42/75.02
2005/0188591 A1* 9/2005 Stone ..... 42/75.02
2005/0235546 A1* 10/2005 Wonisch et al. ..... 42/75.01
2005/0262752 A1* 12/2005 Robinson et al. ..... 42/71.01
2006/0032103 A1* 2/2006 Wossner et al. ..... 42/75.02

* cited by examiner

MODULAR FIREARM

CROSS-REFERENCE TO RELATED APPLICATION(S)

This application claims the benefit of U.S. Provisional Application No. 60/580,256 filed Jun. 16, 2004 which is incorporated by reference herein in its entirety.

BACKGROUND

1. Field of the Invention

The present invention relates to a firearm and, more particularly, to a firearm having modular subassemblies.

2. Brief Description of Earlier Developments

There are conventional firearms with an integral upper receiver and hand guard. The conventional firearms have a removable hand guard section connected to the hand guard on the upper receiver with screws. Removal of the conventional hand guard section hence involves removal tools, and once removed the mounting screws may be lost. This is not desirable in operational conditions.

SUMMARY OF THE INVENTION

In accordance with one exemplary embodiment of the present invention, an M-4 firearm is provided. The firearm comprises a lower receiver assembly and upper receiver assembly. The upper receiver assembly is connected to the lower receiver assembly. The lower receiver assembly has a fire control assembly. The upper receiver assembly has a barrel and a hand guard. The hand guard has venting features for allowing cooling air to pass therethrough. The hand guard has a heat shield mounted therein. The hand guard has at least one peripheral device mounting rail. The hand guard has an upper portion and a removable lower portion. The removable lower portion has at least one peripheral device mounting rail. The removable lower portion may be removed and replaced with a different second removable lower portion without removal of fasteners.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
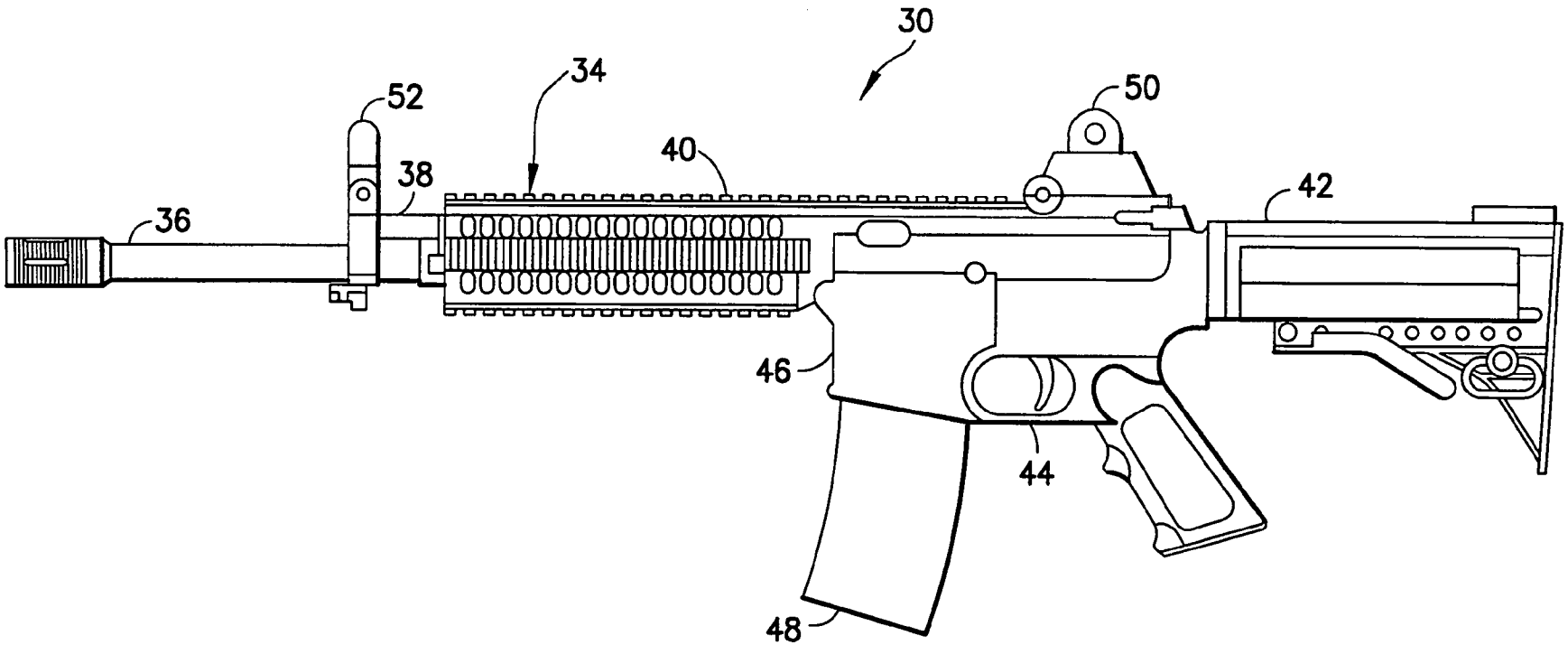
FIG. 1 is a side elevation view of an automatic firearm incorporating features in accordance with an exemplary embodiment.

Referring to FIG. 1, there is shown, a side elevation view of an automatic firearm 30 capable of automatic or semiautomatic fire incorporating features in accordance with an exemplary embodiment of the present invention.

Although the present invention will be described with reference to the embodiments shown in the drawings, it should be understood that the present invention can be embodied in many alternate forms of embodiments. In addition, any suitable size, shape or type of elements or materials could be used.

Firearm 30 may be gas operated, like examples, such as the M4 or M16 type. Firearm 30 may have operational features such as disclosed in U.S. Pat. Nos. 5,726,377, 5,760,328, 4,658,702, 4,433,610, U.S. Non Provisional patent application Ser. No. 10/836,443 filed Apr. 30, 2004, and U.S. Provisional Patent Application filed Apr. 23, 2004, all of which are hereby incorporated by reference herein in their entirety. The firearm 30 and its sections described in greater detail below is merely exemplary, and in alternate embodiments the firearm 30 may have other sections, portions or systems. Firearm 30 may incorporate an upper receiver section 34 incorporating a barrel 36, gas tube 38, and hand guard 40. In alternate embodiments, the firearm may have an indirect gas operating system. In that event, the gas tube may be replaced by a gas operated linkage actuating the bolt carriage in the upper receiver. Firearm 30 may incorporate stock 42, lower receiver section 44, magazine well 46, clip or magazine 48 and rear and front sights 50, 52. As will be described below, upper receiver 34 having barrel 36, lower receiver 44 and magazine well 46 are modular and configurable such that firearm 30 comprises a modular rifle design. In addition, lower receiver 44 and magazine well 46 may be removable without tools or fasteners. In alternate embodiments, more or less modules and assemblies may be removable without tools or fasteners. As an example, magazine well 46 may be replaceable and removable such that magazine well 46 may be replaced with a different magazine well to change caliber. Additionally, modularity with interlocking components is provided for ease of assembly and disassembly without affecting fire accuracy as well as to provide a single configurable firearm without having to support multiple firearms. Further, the hand guard, and accessory mounting rails thereon, may be integral with the upper receiver and the integral upper receiver, hand guard and mounting rails may be of unitary construction.

Figure 2:
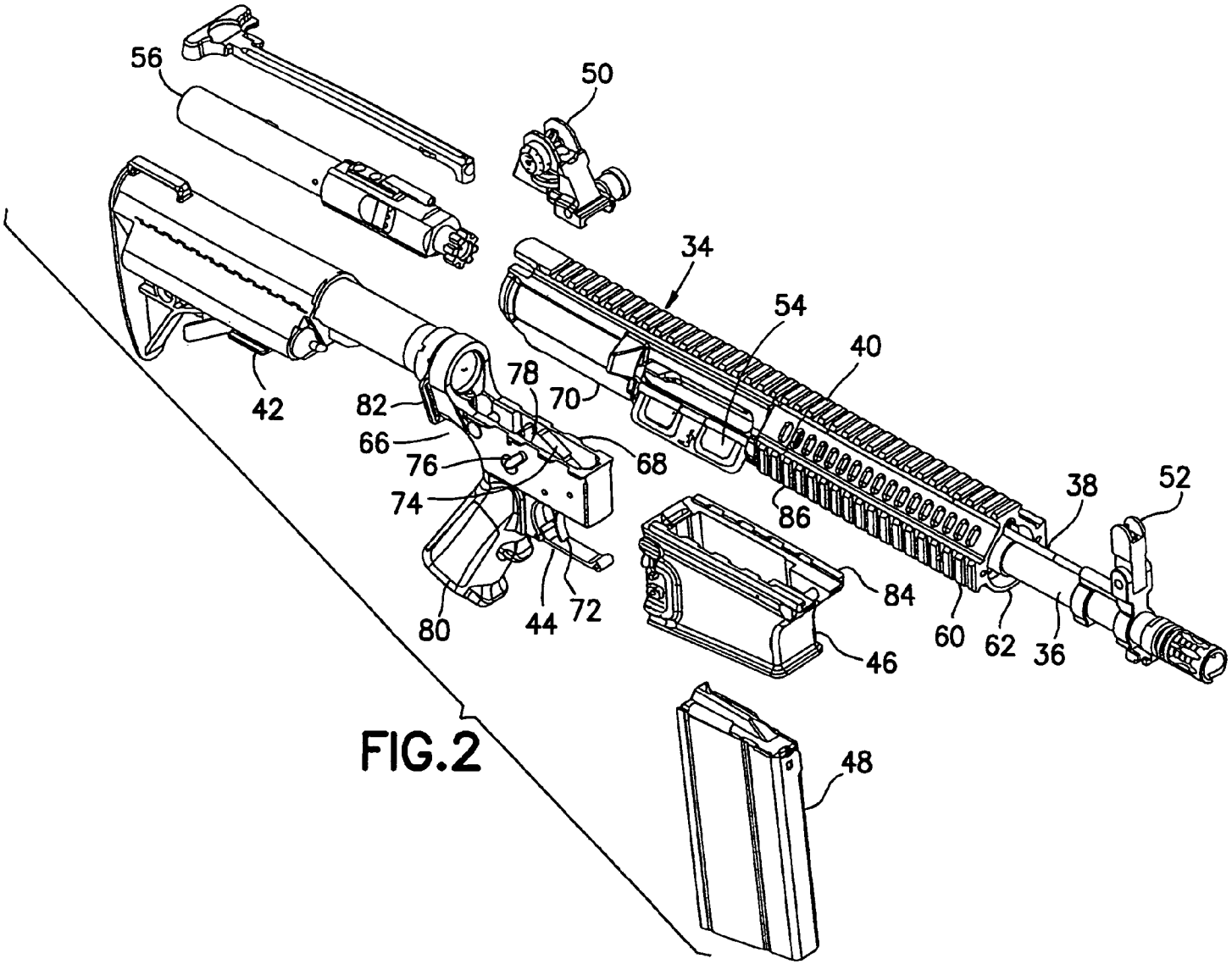
FIG. 2 is an exploded isometric view of the automatic firearm shown in FIG. 1.

Referring now to FIG. 2, there is shown an exploded isometric view of the automatic firearm shown in FIG. 1. Firearm 30 incorporates an upper receiver section 34, barrel 36, gas tube 38, hand guard 40, rear and front sights 50, 52, ejection port cover attachment 54 and bolt assembly 56. Firearm 30 may incorporate stock 42, lower receiver section 44, magazine well 46, clip or magazine 48 and auto sear actuator 66 assembled to the bolt carrier (not shown). The barrel 36 and or the bolt/bolt carrier 56 may be coupled to upper receiver section using conventional splined and/or threaded/pinned locking techniques or otherwise. Hand Guard 40 may have features such as disclosed in U.S. Pat. Nos. 4,663,875 and 4,536,982, both of which are hereby incorporated by reference herein in their entirety. Hand Guard 40 has features for mounting additional devices on one or more rails as shown and may be configured with such rails as a "Piccatiny Rail" configuration as described in Military Standard 1913, which is hereby incorporated by reference herein in its entirety. The hand guard and rails may be made from any suitable material such as hard coat anodized aluminum as an example. Hand Guard 40 may be configured for basic mission profiles or light duty rail requirements while simplifying techniques such as the Gun/Light technique with firearms such as the M4. The peripheral devices may be devices such as sights, illumination devices, vision enhancing devices, launchers, laser aiming devices, Global Positioning or aiming devices or otherwise. In alternate embodiments, more or less similar or different devices may be provided and more or less rail(s) may be provided. Receiver assembly 34 may be of one-piece construction incorporating integral hand guard 40 having fixed rails at the 3/9/12 o'clock positions. Receiver assembly 34 may have a monolithic upper receiver with an integral barrel and hand guard and/or bolt. Hand guard 40 has a removable bottom portion with integral lower 6 o'clock rail 60 for different mounting options that may be provided. The bottom portion 60 may be removable to install other accessories, such a grenade launcher as an example. The removable bottom portion having an integral rail is mounted using a keyed/key way system or tongue and groove system that will be described in more detail below. Support ring 62 is provided at the front of the receiver assembly 34 for strength and attachment purposes. Support or strengthening ring 62 of the upper portion of the hand guard 40 provides a more stable assembly to facilitate manufacture as well as provides a section for the attachment of additional alternate attachments. Lower receiver 44 has interface 68 that removably interlocks with mating interface 70 of upper receiver 34. Interfaces 68, 70 may have a tabbed rim lips that slide relative to each other to lock and unlock allowing the user to lock/assemble and unlock/disassemble the two assemblies without tools and without other disassembly. Interface 68 has features that mate with features on interface 70 that allow lower receiver 44 and upper receiver 34 to be mated and then slid into a locked position for coupling. To de couple lower receiver 44 and upper receiver 34, a clip or pin is depressed, lower receiver 44 is slid relative to upper receiver 34 and the two separated. In this manner the two portions are coupled and de coupled without fasteners or special tools. In alternate embodiments, other mating and locking features could be provided. In this manner, the modular lower receiver interlocks with the modular upper receiver and different receivers with the same interface can be interchanged without further disassembly. Lower receiver 44 has features such as trigger 72, hammer 74, fire control selector 76, auto sear 78. Lower receiver 44 may have integral grip 80 and fixtures 82 for mounting stock 42. Magazine well 46 has interface 84 that removably interlocks with mating interface 86 of upper receiver 34. Interface 86 may be similar to or the same as interfaces 70 or 68 or may be different. Interfaces 84, 86 may have a tabbed rim lips that slide relative to each other to lock and unlock allowing the user to lock/assemble and unlock/disassemble the two assemblies without tools and without other disassembly. Interface 84 has features that mate with features on interface 86 that allow magazine well 46 and upper receiver 34 to be mated and then slid into a locked position for coupling. To de couple magazine well 46 and upper receiver 34, a clip or pin is depressed, magazine well 46 is slid relative to upper receiver 34 and the two separated. In this manner the two portions are coupled and de coupled without fasteners. In alternate embodiments, other mating and locking features could be provided. In this manner, the modular magazine well 46 interlocks with the modular upper receiver and different receivers and wells with the same interface can be interchanged without further disassembly. Magazine well receiver module 46 is positioned in front of lower receiver 44 as shown and interfaces with a corresponding portion of upper receiver 34. Magazine well receiver module 46 may butt against a corresponding surface of lower receiver 44 and may accept the trigger guard of lower receiver 44 in a recess or in a snap-in fashion. With a conventional firearm, the user must disassemble the main components, in cases with separate fasteners whereas with the present invention, in a "snap and go" fashion, the user may interchange main components and subassemblies without special tools and with out fasteners. As an example, the firearm may be converted from a .223 caliber round to a 9 mm caliber round by replacing the barrel and magazine well and magazine without special tools or fasteners. As a further example, the firearm may be converted from a semi-automatic to automatic by replacing the lower receiver.

Figure 3:
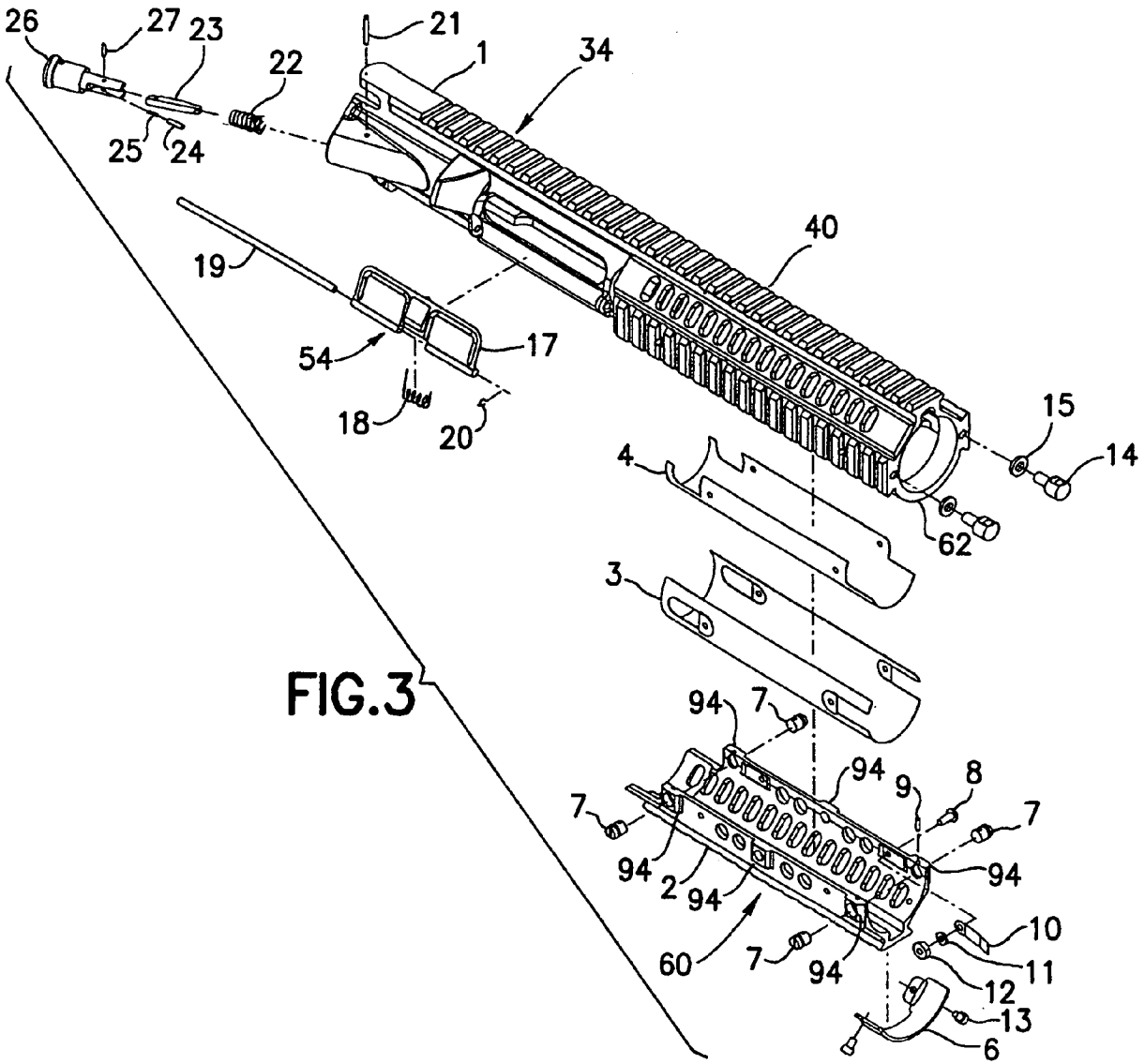
FIG. 3 is an exploded isometric view of the upper receiver with hand guard section of the firearm shown in FIG. 1.

Referring now to FIG. 3, there is shown an exploded isometric view of the upper receiver 34 with hand guard section 40 of the firearm shown in FIG. 1. Hand guard 40 has vent holes, integral external rails, heat shields 3,4 or double heat shields and liners (not shown) to facilitate cooling of the barrel 36 while keeping hand guard 40 at a temperature sufficiently low for an operator. In this embodiment the upper receiver 34 and hand guard 40 may be integrally formed as a single member of unitary construction, the one piece hand guard and upper receiver unit may be formed of any suitable metal, such as steel or Al alloy, or may be formed from non-metallic material such as plastic or composites. Rails are provided on Hand Guard 40 and may be integrally molded. Hence, the "Piccatiny rails", hand guard and upper receiver may be integral as a one piece member of unitary construction. In alternate embodiments the rails may be removably mounted. In alternate embodiments, more or less multiple rails may be provided in multiple mounting locations or mounting angles on hand guard 40. The rails may be manufactured as part of upper receiver assembly 34 such that collimating between the rails device mounting features and the barrel centerline are maintained as desired. Rails are shown as left and right side rails for ambidextrous use. In alternate embodiments, rails may be mounted further forward or rearward or at different angles. Receiver assembly 34 may be of one-piece construction incorporating integral hand guard 40 having fixed rails at the 3/9/12 o'clock positions as shown. Hand guard 40 allows attachment of a removable bottom portion with integral lower 6 o'clock rail 60 for different mounting options that may be provided. The removable bottom portion 60 having an integral rail is mounted using a keyed/key way system or tongue and groove system. A heat shield may be secured to the upper portion using any suitable attachment means such as pins, rivets. The bottom portion has spring loaded movable detents that lock the bottom portion to the upper portion. Accordingly, the bottom portion may be removably attached to the upper hand guard 40 with spring loaded locks that facilitate ease of removal and reattachment of the bottom and upper hand guard portions. Spring tabs 10 (only 1 of 4 shown) are fastened to bottom portion 60 using fasteners 8, 11 and 12 to bias detents 7 outward to protrude past the outer portion of key 94 (4 of 6 places). Pin 9 (1 of 4 shown) engages a cammed recess in detent 7 such that when detent 7 is rotated, detent 7 moves against the spring tabs until flush with the outer portion of key 94. Each of keys 94 engages a mating recess or key way in the upper portion of hand guard 40. Detents 7 engage mating holes in the upper portion of hand guard 40 such that the lower portion 60 may be snapped into the upper portion of hand guard 40 and be positively located and coupled. Removal simply requires pressing in detents 7 (in the case where there are no camming surfaces and the detents 7 are simply retained) or rotating detents 7 to allow lower portion 60 to be separated from the upper portion of hand guard 40. In alternate embodiments, other mating and locking features could be provided to couple lower portion 60 to upper portion 40. Heat shields 3, 4 may be fastened to lower portion 60 using pins or screws or otherwise. Stop 6 may be provided and fastened using fasteners 13 to butt against support ring 62. Support ring 62 is provided at the front of the receiver assembly 34 for strength and attachment purposes. Support or strengthening ring 62 of the upper portion of the hand guard 40 provides a more stable assembly to facilitate manufacture as well as provides a section for the attachment of additional alternate attachments such as by using mounting features 14, 15 to couple attachments, such as a shoulder strap to ring 62. Ejection port cover attachment 54 is coupled to upper receiver assembly 34 using pin 19 and circlip or ring 20 to lock pin 19 to assembly 34. Torsion spring 18 is provided to bias the port cover in the rotated closed position to protect the internal fire mechanism from contamination.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A modular automatic or semi automatic firearm comprising:

an upper receiver assembly having a bolt, a barrel and venting features for allowing cooling air to pass there through;

a lower receiver assembly connected to the upper receiver assembly and having a fire control assembly; and a magazine well connected to the upper receiver assembly and adapted to accept a magazine of cartridges;

wherein, the lower receiver assembly and the magazine well are removably and interlockingly secured to the upper receiver assembly, wherein the magazine well and the barrel are selectable from different interchangeable magazine wells and different interchangeable barrels each having a different predetermined characteristic, and wherein, the lower receiver assembly and the magazine well are removable from the upper receiver assembly without tools and without removal of fasteners.

2. The firearm in claim 1, wherein the firearm is an M-4 firearm.

* * * * *